United States Patent [19]

Woodward

[11] 3,956,161

[45] May 11, 1976

[54] CLEANING COMPOSITIONS CONTAINING $C_{21}$ DICARBOXYLIC ACID

[75] Inventor: Fred E. Woodward, West Palm Beach, Fla.

[73] Assignee: Westvaco Corporation, New York, N.Y.

[22] Filed: June 3, 1974

[21] Appl. No.: 476,042

[52] U.S. Cl. ..... 252/156; 252/DIG. 1; 252/DIG. 10; 252/DIG. 14; 252/89 R

[51] Int. Cl.[2] ..... C11D 10/02

[58] Field of Search ..... 252/156, 89, DIG. 1, 252/DIG. 14, DIG. 6, DIG. 10

[56] References Cited

UNITED STATES PATENTS

| | | | |
|---|---|---|---|
| 3,579,453 | 5/1971 | Dupre et al. | 252/89 |
| 3,725,286 | 4/1973 | Pettigrew | 252/89 |
| 3,734,859 | 5/1973 | Ward | 252/89 |

*Primary Examiner*—Mayer Weinblatt
*Assistant Examiner*—R. Eugene Varndell, Jr.
*Attorney, Agent, or Firm*—William H. Meserole, Jr.; Richard L. Schmalz; Ernest B. Lipscomb, III

[57] ABSTRACT

Compositions containing $C_{21}$ dicarboxylic acid and nonionics in a weight ratio of 20:1 to 1:20, respectively, are provided which are uniquely effective as soluble surfactant systems for liquid alkaline cleaners.

6 Claims, 4 Drawing Figures

CLEANING COMPOSITIONS CONTAINING $C_{21}$ DICARBOXYLIC ACID

BACKGROUND OF THE INVENTION

1. Field of the Invention

This invention relates to the utilization of $C_{21}$ dicarboxylic acid salts as hydrotropes or solubilizing agents in combination with nonionics to form cleaning compositions that are biodegradable and non-toxic.

2. The Prior Art

There is presently an urgent necessity to replace phosphates in cleaning or detergent compositions and particularly in view of anti-pollution laws being enacted to eliminate eutrophication of bodies of water, both above and underground.

U.S. Pat. No. 3,769,223 is illustrative of recent development in the detergent formulation industry. As noted therein, it is practice to combine various chemical compounds or builders with the surfactant or surface-active compound generally employed. The latter are numerous and varied beng anionic, cationic, nonionic, ampholytic and zwitterionic. The "builder" of this patent is an oxacyclopropane polycarboxylic acid or salt thereof, such as 2,3-dicarboxylic acid. While the $C_{21}$ dicarboxylic acid of the present invention also contains two carboxyl groups, the compounds are otherwise clearly chemically unrelated in chemical structure and derivation.

BRIEF DESCRIPTION OF THE DRAWINGS

FIG. I portrays the titration of $C_{21}$ dicarboxylic acid with KOH, thus forming a potassium salt.

FIG. II displays the low-foaming characteristic of the $C_{21}$ dicarboxylic acid-nonionic formulation of the present invention.

FIG. III, relating to WETTING TIME, demonstrates the improved economic and wetting capabilities of the invention cleaning composition at 49°C.

FIG. IV, like FIG. III, relates to WETTING TIME, but at a lower temperature of 27°C. Operation at low temperatures is of great value to the worker in the art.

SUMMARY OF THE INVENTION

The compatibility of nonionics in silicate or caustic systems is improved by incorporating therein salts of $C_{21}$ dicarboxylic acids. Ammonium, sodium, and potassium salts, for example, are water soluble to high solids level. A clear solution is obtainable by using enough base to reach a pH of at least 7.4, but two equivalents of base are not needed. $C_{21}$ dicarboxylic acid salts not only have unusual solubility, but also are excellent hydrotropes and are useful to solubilize disinfectants such as phenols, silicate, or caustic systems as above stated.

It is an object of the invention to provide a new class of cleaning compositions containing $C_{21}$ dicarboxylic acid salts and nonionics while maintaining biodegradability. A further object is to provide such a composition that is so proportioned as to solubilize the nonionic and thus improve the compatibility of the nonionic to thus attain a highly alkaline cleaning composition. These and other objects will become apparent from the invention as described herein.

DETAILED DESCRIPTION OF THE INVENTION

The $C_{21}$ dicarboxylic acid is prepared by reacting linoleic acid with acrylic acid in the presence of iodine catalyst involving a Diels-Alder or diene synthesis type of condensation reaction. This is described in U.S. Pat. No. 3,753,968, incorporated by reference herein. The $C_{21}$ dicarboxylic acid is completely biodegradable and non-toxic.

The linoleic acid used in the reaction with acrylic acid is derived from various animal, vegetable and tall oil sources. Particular vegetable oil sources are the drying and semi-drying oils such as soybean, linseed, tung, perilla oticica, cottonseed, corn, sunflower and dehydrated castor oils.

CHEMICAL AND PHYSICAL CHARACTERISTICS

The $C_{21}$ dicarboxylic acid is a cycloaliphatic dicarboxylic acid having the structure,

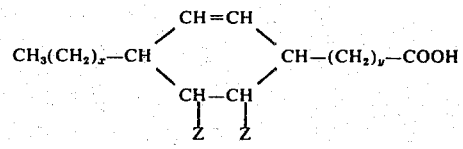

wherein $x$ and $y$ are integers from 3 to 9, $x$ and $y$ together equal 12, wherein one Z is hydrogen (H) and the other Z is a carboxylic acid group (COOH).

While the isomers wherein $x$ is 5 and $y$ is 7 form a preponderance of the acid composition, there are minor amounts of the $C_{21}$ dicarboxylic acid where the cyclohexene ring varies in position along the carbon chain. Included in the $C_{21}$ dicarboxylic acid composition are also minor amounts of dicarboxylic acids of other molecular weight.

Figure 1:
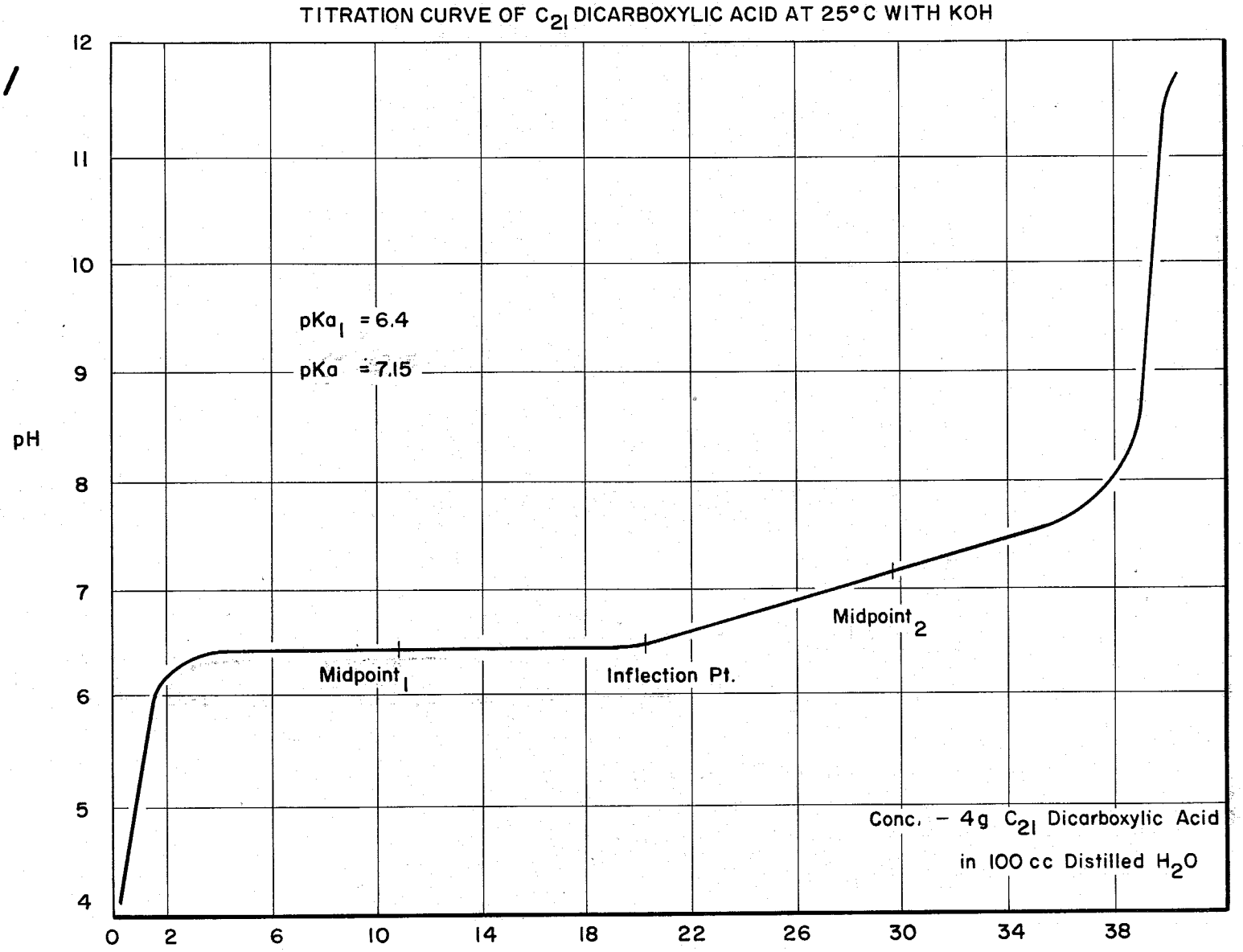
Figure 2:
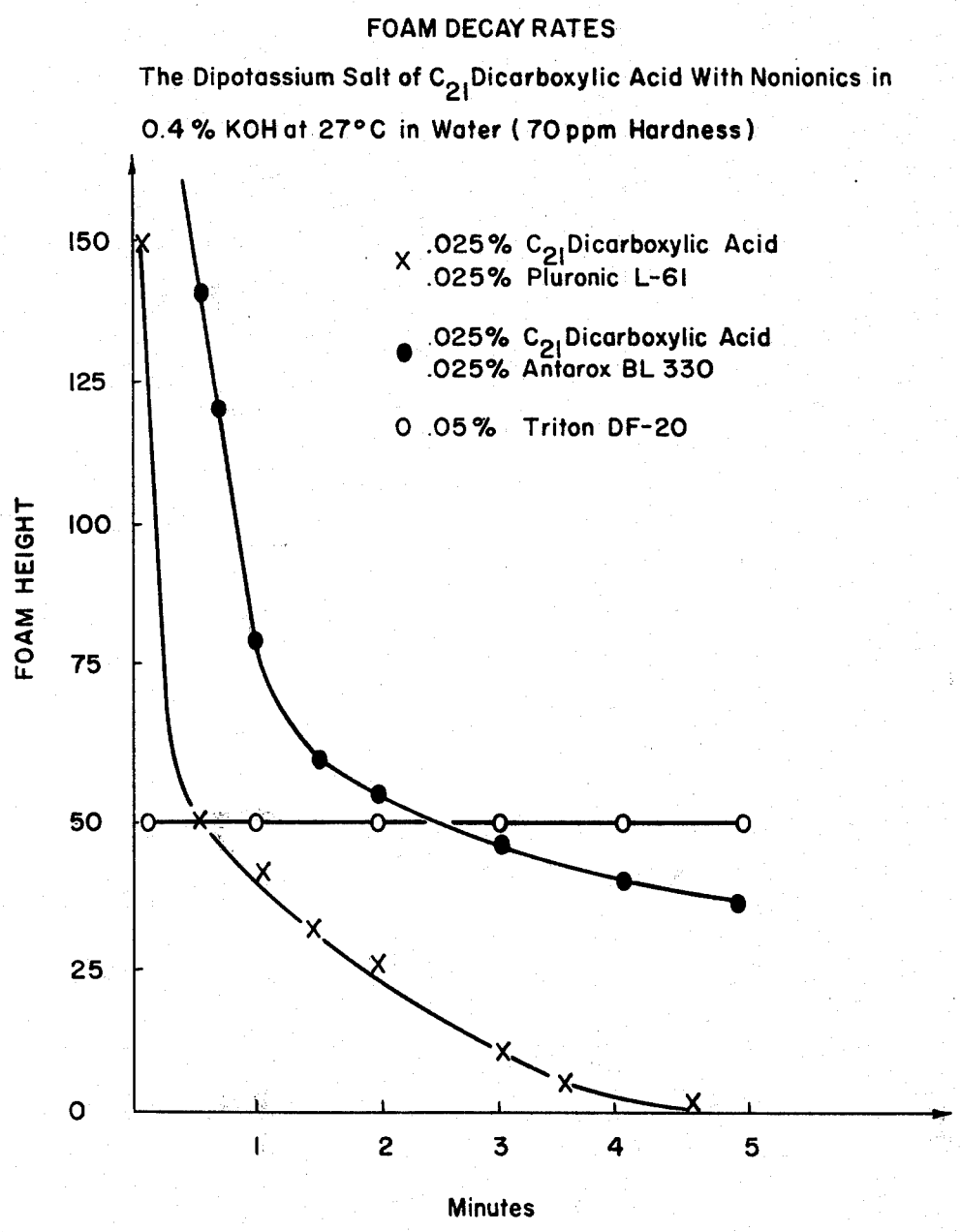
Figure 3:
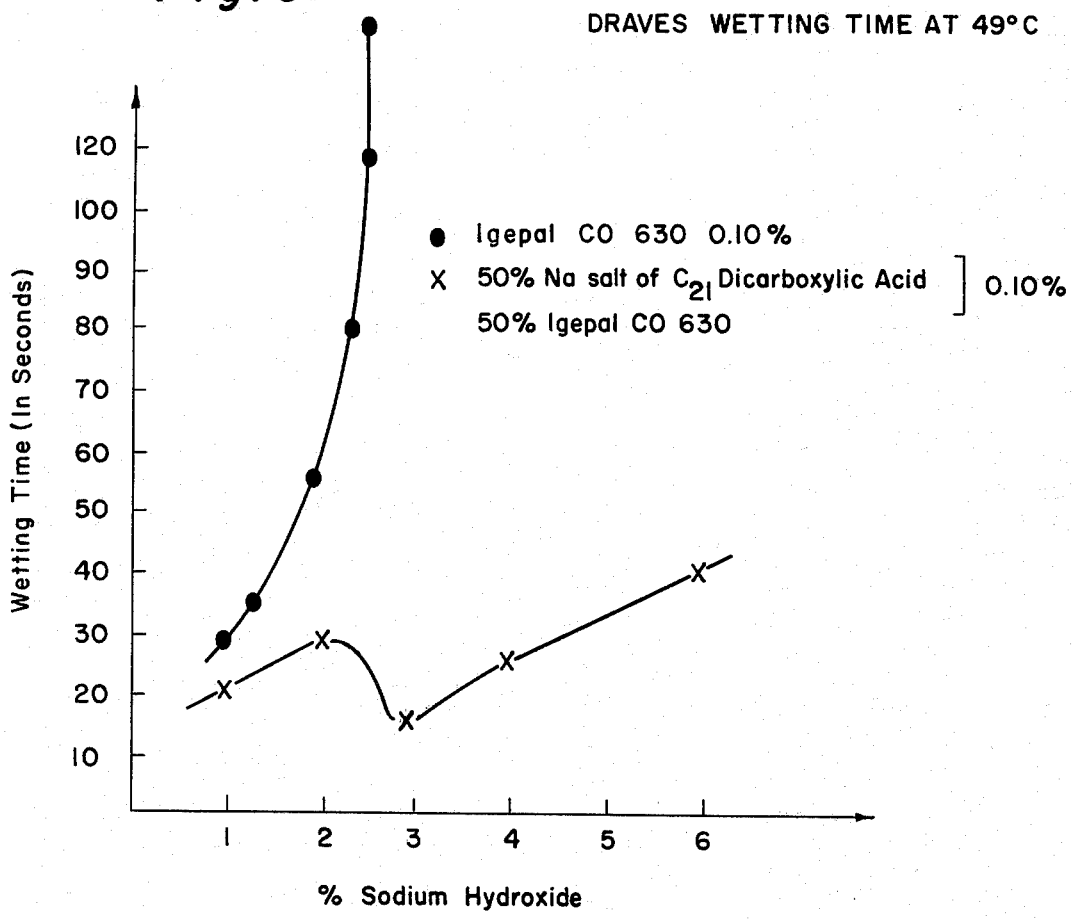
Figure 4:
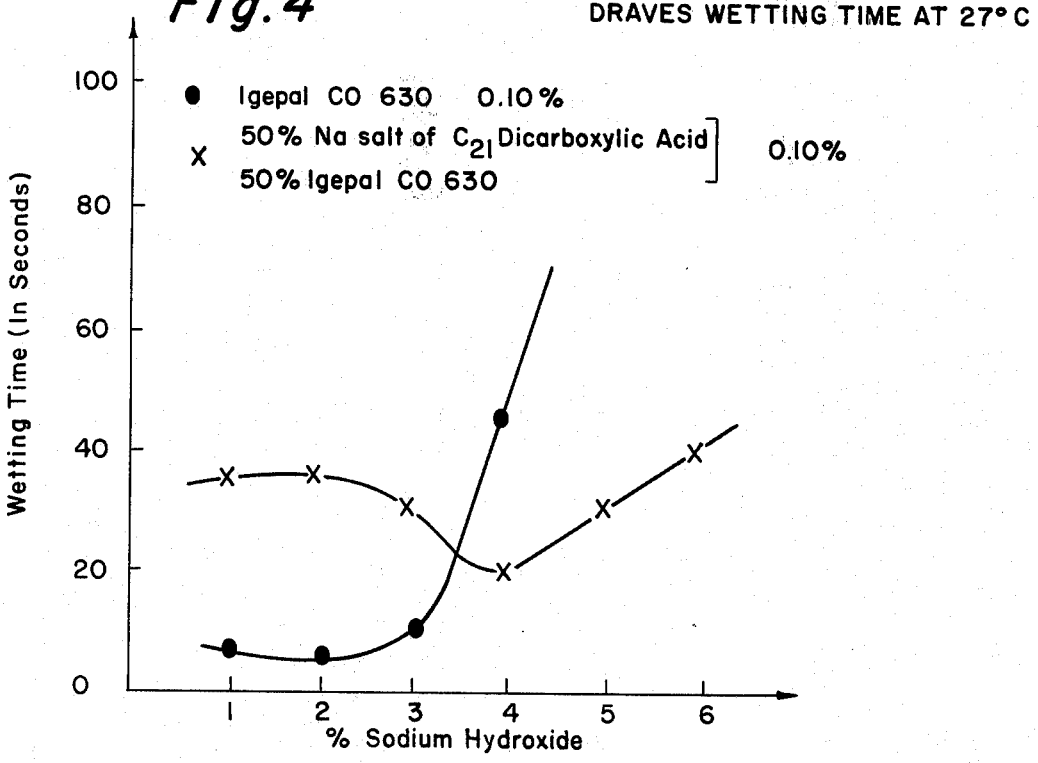

It is seen that $C_{21}$ dicarboxylic acid contains two carboxyl or acid groups. These two acid groups differ in strength, the primary group having a pKa of 6.4, and the secondary group a pKa of 7.15 as seen in FIG. 1. This difference in pKa has a pronounced effect on the properties of the salts and allows for flexibility in pH and in free carboxyl concentration in solution. In Table I the more important physical and chemical properties of this material are listed.

TABLE I

TYPICAL PROPERTIES OF $C_{21}$ DICARBOXYLIC ACID

| | | | |
|---|---|---|---|
| Molecular Weight | 352.5 | Refractive Index at 25°C | 1.485 |
| Saponification Number | 312 | Density at 25°C | 1.024 |
| Activity | 100% | Viscosity (cpa); 100°F | 10,500 |
| | | 210°F | 165 |
| Pour Point | 50°F | Gardner Color | 7 |
| Flash Point | 455°F | $LD_{50}$ (Acute Oral, Albino Rats) | 6176mg/Kg |

PREPARATION OF $C_{21}$ DICARBOXYLIC ACID SALTS

The $C_{21}$ dicarboxylic acid salts are made by neutralizing the $C_{21}$ dicarboxylic acid. The neutralizing agent used is based on the solubility characteristics desired in the soap and economic considerations. To get a clear solution, enough base must be used to reach a pH of at least 7.4, but two equivalents of base are not needed. The neutralizing agents contemplated include those of the following cations, sodium, potassium, lithium and ammonium. These cations may be obtained from such inorganic alkalis as caustic soda, caustic potash, and soda ash. Another cation which may be used is the ammonium cation. Organic amines may also be used, specifically amines such as triethylamine, monoethylamine, diethylamine, and alkanolamines, such as ethanolamine, triethanolamine and diethanolamine. The salts made from the above listed neutralizing agents are all liquid at temperatures as low as 30°F. and are disclosed in U.S. Pat. No. 3,734,859.

Since the $C_{21}$ dicarboxylic acid has two acid groups of different strengths, it is very easy to prepare the mono- or-half-salt of the acid.

The most common salts prepared are the $C_{21}$ dicarboxylic acid potassium and sodium salts, although amine salts also have utility in certain areas. The first three solutions below were prepared by dissolving the base in water and heating to 80°C. The $C_{21}$ dicarboxylic acid was then added with stirring. The fourth example was prepared similarly but at room temperature. Anhydrous salts can, of course, be prepared but normally an aqueous solution is the preferred system. Sample preparations are outlined below:

EXAMPLE 1

| | |
|---|---|
| Dipotassium Salt of | 100 gm of $C_{21}$ dicarboxlic acid |
| $C_{21}$ Dicarboxylic Acid | 76.3 g of 45% potassium hydroxide |
| (50% Solids) | 80 ml of water |
| adjust to pH 10 | |
| | EXAMPLE 2 |
| Disodium Salt of $C_{21}$ | 100 gm of $C_{21}$ dicarboxlic acid |
| Dicarboxylic Acid | 22.3 gm of sodium hydroxide - flake |
| (50% Solids) | 102 ml of water |
| adjust to pH 10 | |
| | EXAMPLE 3 |
| Mono-potassium Salt of | 100 gm of $C_{21}$ dicarboxylic acid |
| $C_{21}$ Dicarboxylic Acid | 45 g of 45% liquid potassium hydroxide |
| (40% Solids) | 145 ml of water |
| | EXAMPLE 4 |
| Diammonium Salt of $C_{21}$ | 100 gm of $C_{21}$ dicarboxylic acid |
| Dicarboxylic Acid | 40.3 gm of ammonium hydroxide (29% $NH_3$) |
| (50% Solids) | 71.4 gm of water |

As is obvious from the pKa values, the mono-salts of $C_{21}$ dicarboxylic acid can be prepared. The salts of $C_{21}$ dicarboxylic acid are water soluble above pH 7.4 and therefore provide the opportunity for preparing neutral solutions of nonionic salts. Such a material could be very useful as an emulsifier in neutral systems or as a surfactant or detergent in low pH formulated detergent systems.

The nonionic agents used in combination with $C_{21}$ dicarboxylic acid salts to prepare the novel cleaning composition of the present invention are variously known as nonionic surfactants, detergents or surface active agents. As a matter of convenience, these will be termed "nonionics" in the present disclosure.

The nonionics suitable for the present invention are commercially available under various names adopted by the manufacturer thereof. The ones so designated are described, for example, in McCutcheons "Detergents and Emulsifiers", 1972 Edition, and the 8th Edition of Condensed Chemical Dictionary.

Nonionic synthetic detergents, made available on the market by Wyandotte Chemicals Corp. under the trade name Pluronic, are formed by condensing ethylene oxide with an hydrophobic base formed by the condensation of propylene oxide with propylene glycol. These are describable as polyoxyalkylene derivatives of polypropylene glycols. Further description of these nonionics is found in U.S. Pat. No. 3,422,021, column 12, lines 16–32; U.S. Pat. No. 3,586,654, column 12, lines 6 et seq. and U.S. Pat. No. 3,563,901, column 3, lines 9 et seq. Those named as Pluronic L-61 or L-62 in the following Example 5 are described in detail in U.S. Pat. No. 3,650,965 as having average molecular weights of 2000 and 2500, respectively, and approximate percentages of ethylene oxide of 10 and 20, respectively.

The Igepal nonionics, made by General Aniline and Film Co., are described as alkylphenoxy poly(oxyethylene) ethanols resulting from the combination of an alkylphenol with ethylene oxide. These are described as ethylene oxide ethers of alkyl phenols such as nonylphenol polyoxyethylene ether. The Igepal CO-630 of Example 6 and Table II below is identified in U.S. Pat. No. 3,563,901, column 3 (a), lines 6–8 as "nonylphenoxy poly(ethyleneoxy) ethanol."

Certain nonionic Plurafac wetting agents are described in U.S. Pat. No. 3,563,901, column 3, (c) and (j), lines 13 and 26–27, respectively. These are made by the Wyandotte Chemicals Corp. and described generically as straight chain primary aliphatic oxyethylated alcohols. The Plurafac RA 43 of Table II below is identified in the 1972 Edition of McCutcheons' "Detergents and Emulsifiers".

The nonionic "Antarox BL 330", appearing in FIG. II of the present application is described in U.S. Pat. No. 3,563,901, column 3, (i) as being an aliphatic polyether. The Antarox class is also found described in McCutcheons'.

The Neodol type of nonionic, made by Shell Chemical Co., are $C_{12}$–$C_{15}$ linear primary alcohol ethoxylates. The specific Neodol 25-7 and Neodol 25-9 mols of ethylene oxide, respectively, per mol of alcohol, as described in McCutcheons' 1972 Edition.

Additional information as to nonionics can further be obtained from the following patents:

| | |
|---|---|
| 1,970,578 | 3,526,592 |
| 2,213,477 | 3,527,608 |
| 2,577,773 | 3,769,223 |
| 2,950,255 | |

$C_{21}$ DICARBOXYLIC ACID AS A SOLUBILIZER FOR NONIONICS IN HIGHLY ALKALINE SOLUTIONS

The salts of $C_{21}$ dicarboxylic acid mixed with nonionics make uniquely effective, soluble surfactant systems for liquid alkaline cleaners. A general formula for particularly successful formulations is as follows:

| | |
|---|---|
| $C_{21}$ Dicarboxylic Acid Sodium Salt (anhydrous basis) | 2 to 10% |
| Nonionic | 2 to 6% |
| Sodium Hydroxide | 10 to 30% |
| Water | Balance to 100% |

The following examples demonstrate the ability of $C_{21}$ dicarboxylic acid to serve as a hydrotrope for various nonionics in highly alkaline systems.

| | |
|---|---|
| EXAMPLE 5 | |
| $C_{21}$ Dicarboxylic Acid Sodium Salt (anhydrous basis) | 5.0% |
| Sodium Hydroxide | 15.0% |
| Igepal CO-630 | 2.8% |
| Water | 77.2% |
| EXAMPLE 6 | |
| $C_{21}$ Dicarboxylic Acid | 6.8% |
| Potassium Hydroxide | 20.4% |
| Pluronic L-61 or L-62 | 3.9% |
| Water | 68.9% |
| EXAMPLE 7 | |
| $C_{21}$ Dicarboxylic Acid | 6.8% |
| Potassium Hydroxide | 20.4% |
| Igepal CO-630 | 3.9% |
| Water | 68.9% |

In each of these examples, $C_{21}$ dicarboxylic acid was effective as solubilizing the nonionic.

EXAMPLE 8

This example is to illustrate the $C_{21}$ dicarboxylic acid is an effective hydrotrope at a ratio of 1:20 $C_{21}$ dicarboxylic acid/nonionic.

| | |
|---|---|
| $C_{21}$ Dicarboxylic Acid | 0.025% |
| Sodium Hydroxide | 4.5 % |
| Igepal CO-630 | 0.475% |
| Water | 95.0 % |

The nonionic was solubilized in this formulation.

The ratio of $C_{21}$ dicarboxylic acid to nonionic by weight is from about 20:1 to 1:20, respectively, and preferably 3:1 to 1:2, respectively.

EXAMPLE 9

This example illustrates the solubilizing effects on nonionics of the potassium salt of $C_{21}$ dicarboxylic acid in Table II below and the solubilizing effect of the sodium salt in Table III.

TABLE II

| 40% DiAcid Potassium Salt 1:1 Anhydrous Basis With: | Maximum Concentration of KOH |
|---|---|
| Pluronic L-61 | 34.4% |
| Pluronic L-62 | 31.0% |
| Plurafac RA-43 | 20.5% |
| Neodol 25-7 | 24.6% |
| Neodol 25-9 | 26.0% |
| Tergitol NXF (Igepal-630) | 19.3% |

TABLE III

SOLUBILIZING OF NONIONICS IN ALKALINE SALT SYSTEMS WITH SODIUM $C_{21}$ DICARBOXYLIC ACID

| $C_{21}$ Dicarboxylic Acid Sodium Salt 1:1 with Nonionic[1] | Maximum Concentration of NaOH | Maximum Concentration of Sodium Silicate (2.50:1)[2] | Maximum Concentration of KOH |
|---|---|---|---|
| Pluronic L-61 | 20.0% | 23.0% | 24.0% |
| Pluronic L-62 | 19.0% | 18.5% | 21.0% |
| Neodol 25-7 | 15 % | 20 % | 19 % |
| Neodol 25-9 | 15 % | 18 % | 20 % |
| Igepal Co-630 | 15 % | <15 % | 19.3% |
| Plurafa c RA-43 | <10 % | — | 14 % |

Notes:

[1]Mixtures are 57% solutions in water. The 1:1 ratio is on the basis of the anhydrous $C_{21}$ dicarboxylic acid sodium salt.

[2]Percentages are silicate solids ($Na_2O + SiO_2$)

The aforesaid Tables II and III show further the solubilizing ability for $C_{21}$ dicarboxylic acid salts to serve as hydrotropes or as solubilizers in alkaline systems.

EXAMPLE 10

Foam Decay Rates of $C_{21}$ Dicarboxylic Acid/Nonionic Formulations

As has been demonstrated, $C_{21}$ dicarboxylic acid is an extremely effective solubilizer for nonionics in alkaline systems. In many alkaline systems low foam is important. To evaluate foaming properties and foam decay rates, the following formulation was used:

25% Surfactant (active basis)
20.0% Potassium Hydroxide
77.5% Water

The above solution was diluted 49:1 with water and tested in a Nasco Electronics Blender. Two nonionic/$C_{21}$ dicarboxylic acid combinations were evaluated. Foam generation time was thirty seconds. At this point the increase in volume over the 200 ml of solution used was plotted versus time (see FIG. II). The results show that the $C_{21}$ dicarboxylic acid/nonionic mixtures have excellent foam decay rates, performing even better than the low foaming alkaline soluble nonionic, Triton DF-20. This data demonstrates that $C_{21}$ dicarboxylic acid can be used to solubilize the lower priced low foaming nonionics to give excellent alkaline cleaner systems having good foam decay rates.

EXAMPLE 11

$C_{21}$ Dicarboxylic Acid/Nonionic Combinations as Wetting Agents

In cases where the formulator has difficulty in obtaining good wetting properties with nonionics in alkaline systems, the solubilizing effects of $C_{21}$ dicarboxylic acid offer an inexpensive answer. For example, $C_{21}$ dicarboxylic acid sodium salt mixed 1:1 on an active basis with ethoxylated nonyl phenol (10 moles) makes an economical wetting agent, useful in textiles and other applications. FIGS. III and IV show the wetting ability of $C_{21}$ dicarboxylic acid/nonionic combinations in alkaline systems.

EXAMPLE 12

A $C_{21}$ dicarboxylic acid/nonionic blend was evaluated against KOH and Triton DF-20/KOH as a cleaner for metal plates. For this test, standard Q-panels were painted with synthetic sebum and baked for 5 minutes at 230°–240°C. These plates were then soaked at room temperature for 1 hour and dirt removal observed.

| Formula | % Sebum Removal |
|---|---|
| 16.2% KOH<br>83.8% Water | 0–2% |
| 16.2% KOH<br>6.8% Triton DF-20<br>77.0% Water | 50% |
| 16.2% KOH<br>3.4% Dipotassium Salt of $C_{21}$ Dicarboxylic Acid<br>3.4% Neodol 25-9<br>77.0% Water | 78% |

These tests again illustrate the point that by using a lower priced nonionic in conjunction with $C_{21}$ dicarboxylic acid results comparable or superior to present systems may be realized.

While the invention has been described and illustrated herein by references to various specific materials, procedures and examples, it is understood that the invention is not restricted to the particular materials, combinations of materials, and procedures selected for that purpose. Numerous variations of such details can be employed, as will be appreciated by those skilled in the art.

What is claimed is:

1. A clear, water soluble, biodegradable alkaline cleaning solution consisting essentially of:

a. a salt of a $C_{21}$ dicarboxylic acid of the formula

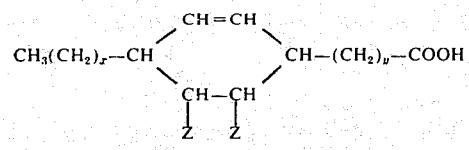

wherein $x$ and $y$ are integers from 3 to 9, $x$ and $y$ together equal 12, where one Z is hydrogen and the other Z is a carboxylic acid group, the primary carboxylic acid group has a pKa of 6.4, and the secondary carboxylic acid group has a pKa of 7.15, and a base selected from the group consisting of sodium hydroxide, potassium hydroxide and ammonium hydroxide in an amount of 10 to 30%, and b. a nonionic surfactant, said nonionic surfactant and salt being in a weight ratio of from about 20:1 to 1:20, and whereby the $C_{21}$ dicarboxylic acid salt solubilizes the nonionic surfactant.

2. The solution according to claim 1 wherein the ratio of nonionic surfactant to the $C_{21}$ dicarboxylic acid salt is 3:1 to 1:2.

3. The solution according to claim 2 wherein the isomers represented by X=5 and Y=7 form a preponderance of the solution.

4. The solution according to claim 2 wherein the alkali metal is potassium.

5. The solution according to claim 2 wherein the alkali metal is sodium.

6. An alkaline cleaning solution according to claim 5 of the following formulation:

a. 2 to 10% of $C_{21}$ dicarboxylic acid, (anhydrous basis)

b. 2 to 6% of a nonionic surfactant, c. 10 to 30% by weight of sodium hydroxide, and d. balance to 100% of water.

* * * * *